United States Patent [19]

Jarrett

[11] Patent Number: 5,008,969

[45] Date of Patent: Apr. 23, 1991

[54] SEPARABLE MULTI-LAYERED WIPING MITTEN

[76] Inventor: Guy R. Jarrett, 2013 College Ave., Modesto, Calif. 95350

[21] Appl. No.: 556,355

[22] Filed: Jul. 23, 1990

[51] Int. Cl.[5] ..... A47L 13/18

[52] U.S. Cl. ..... 15/227; 15/104 A

[58] Field of Search ..... 15/104 A, 227

[56] References Cited

U.S. PATENT DOCUMENTS

| | | | |
|---|---|---|---|
| 2,239,919 | 4/1941 | Lindfelt | 15/227 |
| 2,505,409 | 4/1950 | Kirchner | 15/227 |
| 2,663,890 | 12/1953 | Sullins | 15/227 X |
| 2,715,742 | 8/1955 | Coles | 15/104 A X |
| 2,724,847 | 11/1955 | Krasno | 15/104 A |
| 4,964,188 | 10/1990 | Olson | 15/227 |

*Primary Examiner*—Chris K. Moore

*Attorney, Agent, or Firm*—Basil Travis

[57] ABSTRACT

A multi-layered cloth mitten to be worn by the human hand for wiping surfaces prior to painting has been invented whereby the outer concentric layer of said mitten may be removed as it becomes soiled and the wiping operation may be continued with successive concentric clean layers of said mitten.

3 Claims, 1 Drawing Sheet

SEPARABLE MULTI-LAYERED WIPING MITTEN

BACKGROUND OF THE INVENTION

This invention relates to cleaning implements, such as chamols, sponges and rags used for cleaning dirt, dust and debris from surfaces. More particularly, the present invention pertains to a multi-layered cloth mitten to be worn by the human hand for wiping surfaces prior to painting them. As the outer concentric layer of said mitten becomes soiled, it is removed and the wiping may be continued with the successive concentric layers of said mitten. In its simplest form the present invention is limited to a woven fabric, such as cotton, of two concentric layers in the shape of a mitten. But in its broadest scope this invention includes a plurality of woven and non-woven layers of fabric, which may include paper materials, worn by the human hand for wiping and cleaning a particular type of surface.

As it is perhaps well known, the painting of a surface requires that it be clean and it is often said that proper surface preparation is the most important step in any painting application. Normally, surfaces are abraded by several common methods and then wiped clean with a rag prior to painting but this is not efficient use of the surface area of the rag because it is usually held by the human hand in a wrinkled position causing a shrinking of the surface area by numerous small ridges or furrows which prevent much of the surface area of the rag comming into contact with the surface to be cleaned. As the ridges and furrows of the rag accumulate dirt and debris the efficiency of the rag's cleaning surface decreases and the wiping operation usually must be halted to allow altering the position of the rag or substitution altogether. It would be an obvious improvement over the present state of the art to provide a cleaning implement that would avoid these problems.

Accordingly, it is the general object of the present invention to provide a cleaning implement having a common center which may be worn by the human hand.

It is another object of the present invention to provide a cleaning implement consisting of concentric layers of fabric whereby the outer layer may be removed when it is soiled and cleaning operations may be continued with successive concentric layers.

It is yet another object of the present invention to provide a cleaning implement of concentric multi-layers in the general shape of a mitten whereby each successive outer layer may be removed as it becomes solied.

These objects and other objects and advantages of the present invention will be apparent from the following description.

SUMMARY OF THE INVENTION

In accordance with the present invention, a concentric multi-layered fabric in the general shape of a mitten is provided for wiping surfaces prior to painting. The fabric of said mitten may be woven or non-woven or a combination of both, but compatable with the particular surface it is to clean. The shape of the mitten, with a single section for all four human fingers and another section for the thumb, makes it relatively easy to remove the outer layers as they become soiled and thereby allows the contineous wiping of a surface with successive layers. In its simplest embodiment the mitten consists of two concentric layers of woven fabric, such as cotton, but in its broadest sense the invention encompasses a mitten with a plurality of concentric layers of woven and/or non-woven fabric for cleaning surfaces generally.

DESCRIPTION OF THE PREFERRED EMBODIMENT

Figure 1:
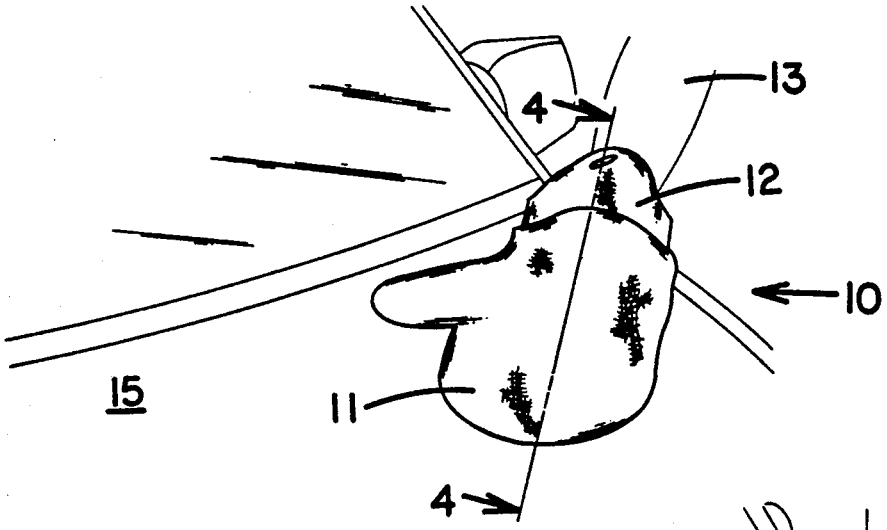
FIG. 1 is a perspective view of the separable multi-layered mitten illustrating its use for wiping the surface of an automobile prior to painting.

Turning now to the drawings, reference numeral 10 generally designates the separable multi-layered wiping mitten of the present invention as illustrated in use for wiping an automobile prior to painting, however it should be pointed out at the outset that said mitten could as well have been illustrated to wipe other surfaces such as furniture and even consisting of more that two fabric layers so that the illustrations should not be construed to limit to scope of the invention but are merely illustrative of how the invention works.

Figure 4:
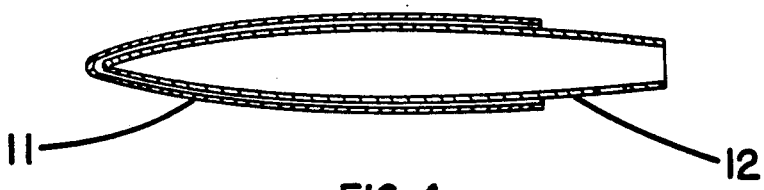
FIG. 4 is a cross-sectional view taken along lines 4—4 of FIG. 1 illustrating two concentric layers of fabric with a common center for insertion of the human hand.

FIG. 1 illustrates the mitten 10 with an outer fabric layer 11 and an inner fabric layer 12 being worn on a human arm 13 of a person (not shown) who is wiping dirt and debris from the hood of an automobile 15 (shown in light lines) in preparation for painting. Heretofore, such an operation was done with a rag but as previously explained was not very efficient because the gripping of a rag with the human hand causes the surface to become wrinkled with a resulting shrinking of the surface area by numerous small ridges or furrows which also accumulate dirt and debris rather than disperse it over the surface area of the rag. A person using a rag therefore would be required to often stop the wiping operation to alter the position of the rag or substitute it altogether. As illustrated in FIG. 1 the mitten 10 has at least two concentric layers 11 and 12, which may be better seen in FIG. 4 along lines 4—4, where both said fabric layers are worn by a person 13 but only the outer fabric layer 11 comes into contact with the surface to be cleaned 15.

Figure 2:
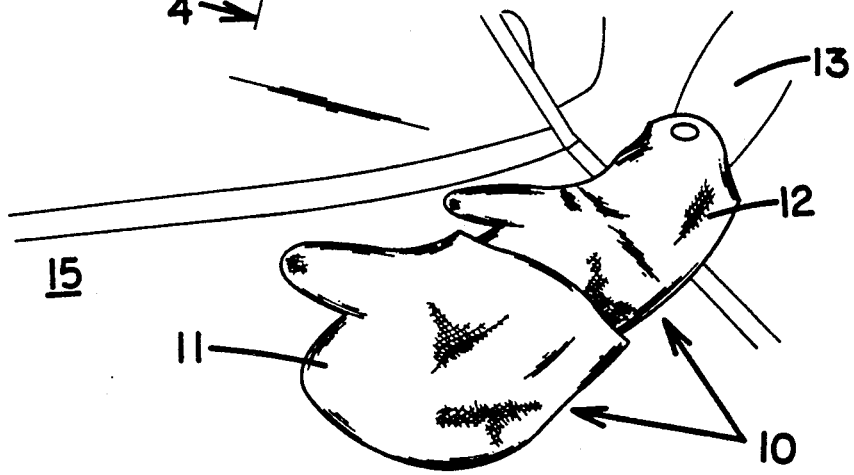
FIG. 2 is the same view as FIG. 1 but illustrating the soiled outer fabirc layer partially removed from an inner fabric layer.
Figure 3:
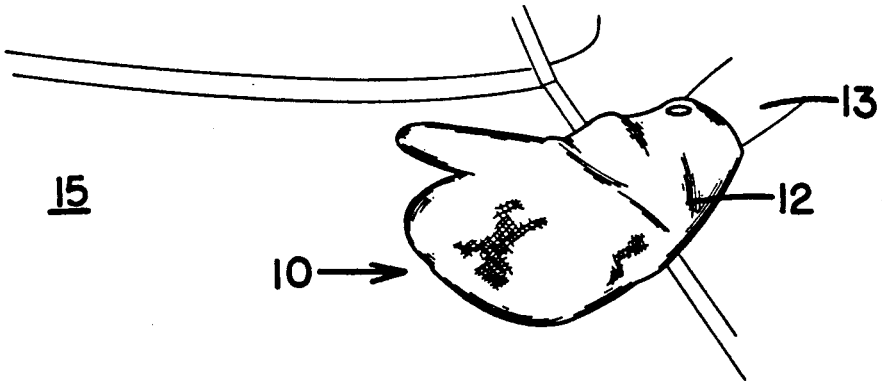
FIG. 3 is the same view as FIGS. 1–2 but showing the wiping operation of an automobile being continued with a clean inner fabric layer of said mitten.

Turning now to FIG. 2 there is illustrated the outer fabric layer, now soiled, 11 being removed from the clean inner layer 12 which may be generally accomplished by pulling it off with the aid of the other hand. FIG. 3 illustrated the wiping operation being continued with the next successive inner fabric layer 12.

In its simplest embodiment the mitten 10 has two concentric fabric layers of woven material such as cotton which might be washed after use and later reassembled to be used again, however in its broadest sense the mitten 10 includes more than two of fabric, either woven and/or non-woven or a combination of both assembled for a particular cleaning operation. Also additional modifications may be obvious to one skilled in the art, for example, a rubber liner may very well be substituted for the inner fabric layer 12 to protect the human hand and arm 13 from absorbing a cleaning solvent that may be applied to the outer fabric layer 11 for particular cleaning applications. Therefore, the goal of the appended claims is to cover all such changes and modifications as fall within the true spirit and scope of the invention.

I claim:

1. A separable multi-layered mitten for wiping surfaces prior to painting, said mitten comprising:

A. at least two concentric fabric layers, the outer said layer removable when soiled from a successive inner layer then itself useable for contineous wiping of said surface;

B. a common center of said concentric fabric layers for insertion of the human hand.

2. The mitten of claim 1 where the concentric multi-layers are greater in number than two and consist of woven and/or non-woven fabric materials.

3. The mitten of calim 1 where a rubber inner concentric layer is provided to protect the human hand against solvents applied to an outer fabric layer for cleaning of surfaces.

* * * * *